US005568926A

United States Patent [19]

Kaptein

[11] Patent Number: 5,568,926

[45] Date of Patent: Oct. 29, 1996

[54] RODEO ROPING PRACTICE STEER

[76] Inventor: Marvin Kaptein, 278 Berland Rd., Conrad, Mont. 59425

[21] Appl. No.: 592,018

[22] Filed: Jan. 26, 1996

[51] Int. Cl.[6] ..... A63B 69/00

[52] U.S. Cl. ..... 273/359; 273/336

[58] Field of Search ..... 273/359, 336, 273/337, 338, 339

[56] References Cited

U.S. PATENT DOCUMENTS

| | | | |
|---|---|---|---|
| 3,303,821 | 2/1967 | Harris | 273/359 X |
| 3,324,832 | 6/1967 | McCain | 273/369 X |
| 3,711,098 | 1/1973 | McCord | 273/336 |
| 3,776,553 | 12/1973 | Kelton | 273/339 |
| 3,802,706 | 4/1974 | Hamm | 273/339 |
| 3,947,033 | 3/1976 | Bennett | 273/339 |
| 3,974,799 | 8/1976 | Parsons | 273/336 |
| 4,136,874 | 1/1979 | McCord | 273/339 |
| 4,155,554 | 5/1979 | Adamski et al. | 273/359 |
| 4,995,618 | 2/1991 | Panzner | 273/339 X |
| 5,286,032 | 2/1994 | Spencer | 273/339 |

*Primary Examiner*—William H. Grieb
*Attorney, Agent, or Firm*—Harold H. Dutton, Jr.; W. Charles L. Jamison; Diane S. Liebman

[57] ABSTRACT

A rodeo roping practice steer comprising a body frame for mounting a body resembling a bovine animal, first pivot connecting element for pivotally attaching a head to the body frame and second pivot connecting element for pivotally attaching at least one pair of legs to the body frame, a cart frame for mounting the body frame, the cart frame including a pair of rear drive wheels and a front castor wheel pivotal about a vertical axis, an electric motor having two output drive shafts, electric clutches/brakes mounted on each of the drive shafts and drivingly connected with the drive wheels, a linkage interconnecting at least one of the drive shafts and the pivot connecting means for pivotally moving the pair of legs, a source of electricity for driving the motor, control means for selectively engaging and disengaging the electric clutch/brake and the second pivot connection, a first sensor member mounted on the body frame for delivering a first signal to the control system in response to a condition sensed by first sensor member and directing a change in the operation of the electric motor in response to the first signal.

11 Claims, 4 Drawing Sheets

RODEO ROPING PRACTICE STEER

This invention relates to a practice steer for rodeo roping events. More particularly, the invention relates to a mechanical steer having a motive power source, and which is capable of movements similar to and simulating the movements of a live steer, and thus enabling practice for the variety of events found in rodeos, or even simulated competitive events.

BACKGROUND AND OBJECTS OF THE INVENTION

The sport of rodeo has been around for a long time in this country, but it has become extremely popular in recent years. Indeed, the sport has become a sport enjoyed by amateurs as well as professional participants. The popularity of rodeo participation has grown to such an extent that many people practice for the various events using mechanical devices to simulate, for examples, riding on wild bulls or horses, roping animals such as calves or steers, and the like.

A number of practice devices have been proposed heretofore for practice roping, and they have met with varying degrees of success. However, such devices for practicing roping have generally only been made to look like a calf or a steer, but not to actually move like the live animal. Most such devices have only been towed by a vehicle or a horse, but did not have their own means of motive power. As a result, the devices have been somewhat restricted in their simulations, and did not provide the variety of practice techniques needed to accurately and realistically simulate the various roping events of a rodeo.

Any such device which is towed is, of necessity, tethered to some type of drive means, either a winch, a horse, a trolley, or the like. The tethering line itself presents significant drawbacks to the use of the device and hampers the mobility and variability of the device. But the drive arrangement or mechanism also presents drawbacks. Any towed device must follow the towing power, and any cable or other mechanical elements used present potential hazards to the roper using the practice device. The roper is usually on a horse, and any fall can be very dangerous to the person or the animal.

One early device is shown in U.S. Pat. No. 3,711,098 to McCord which provides a sled which is towed by a winch cable. A mechanism mounted on the sled allows the sled to travel in a straight, curved or zig-zag path as the winch retrieves the sled. Once the winch is completely wound up, the sled, i.e. the "calf," must be towed back to the starting point for repeated use.

Another prior device of similar type is shown in U.S. Pat. No. 4,136,874 to McCord. This device also is a sled which is towed, for example by a cable, and is vertically adjustable to simulate either a calf or a steer.

Still another roping practice device is shown in U.S. Pat. No. 3,974,799 to Parsons. This device is also towed along the ground, and iS caused to tip rearwardly when roped, so as to release the rope, and returns to normal position when towed further.

U.S. Pat. No. 3,947,033 to Bennett discloses another steer roping practice device which is mounted on wheels attached to a frame structure. The body of the steer is attached in such a way as to be able to lean to one side to more realistically simulate a steer. The device also includes an inertia motor, but this too requires an outside power source to build up the inertia until the device moves under the inertia power. This is generally a towing means.

Other towed or tethered devices are shown in U.S. Pat. Nos. 3,324,832, 3,776,553 and 3,802,706. None of these devices has been able to operate on its own power or move so as to realistically simulate a live steer or calf, and thus these devices all suffer from the same drawbacks.

On the other hand, U.S. Pat. No. 3,303,821 to Harris does show a mechanical cutting calf, which is self propelled and remote controlled. This device is driven by two reversible, electric motors each powered by a storage battery and each driving one of two rear wheels. By energizing both motors the calf is moved forward, but by reversing one of the motors, the calf is caused to turn one direction or the other. A plurality of solenoids are housed in the device and are selectively energized by a radio signal transmitted by an operator, for controlling the movement of the calf, and de-energizing all of the solenoids stops the device. Clearly, this device relies upon human activation to create any random movements of the calf, within the confines of the mechanical movement capability of the device.

Accordingly a primary object of this invention is to provide a realistic steer, calf or other such bovine roping practice device.

Another object of the invention is to provide a roping practice device in which the hind legs kick, and the front legs move, similar to a live animal.

A further object of this invention is to provide a roping practice device in which the size of the animal and its physical characteristics may be varied so as to be able to simulate not just a steer, but a calf or other bovine animal as well.

Still a further object of the invention is to provide a roping practice device which includes its own motive power source and which can be controlled by a computer controlled arrangement to enable random movement, more closely simulating a live animal.

Yet another object of the invention is to provide a roping practice device which can start, stop and turn either direction so as to enable a great variety of roping events, including calf roping, team roping, break away roping, bull dogging, and steer dodging.

These and other objects and advantages of this invention will become apparent from a detailed consideration of the following description and claims, when taken together with the accompanying drawings.

DESCRIPTION OF THE INVENTION

Figure 1:
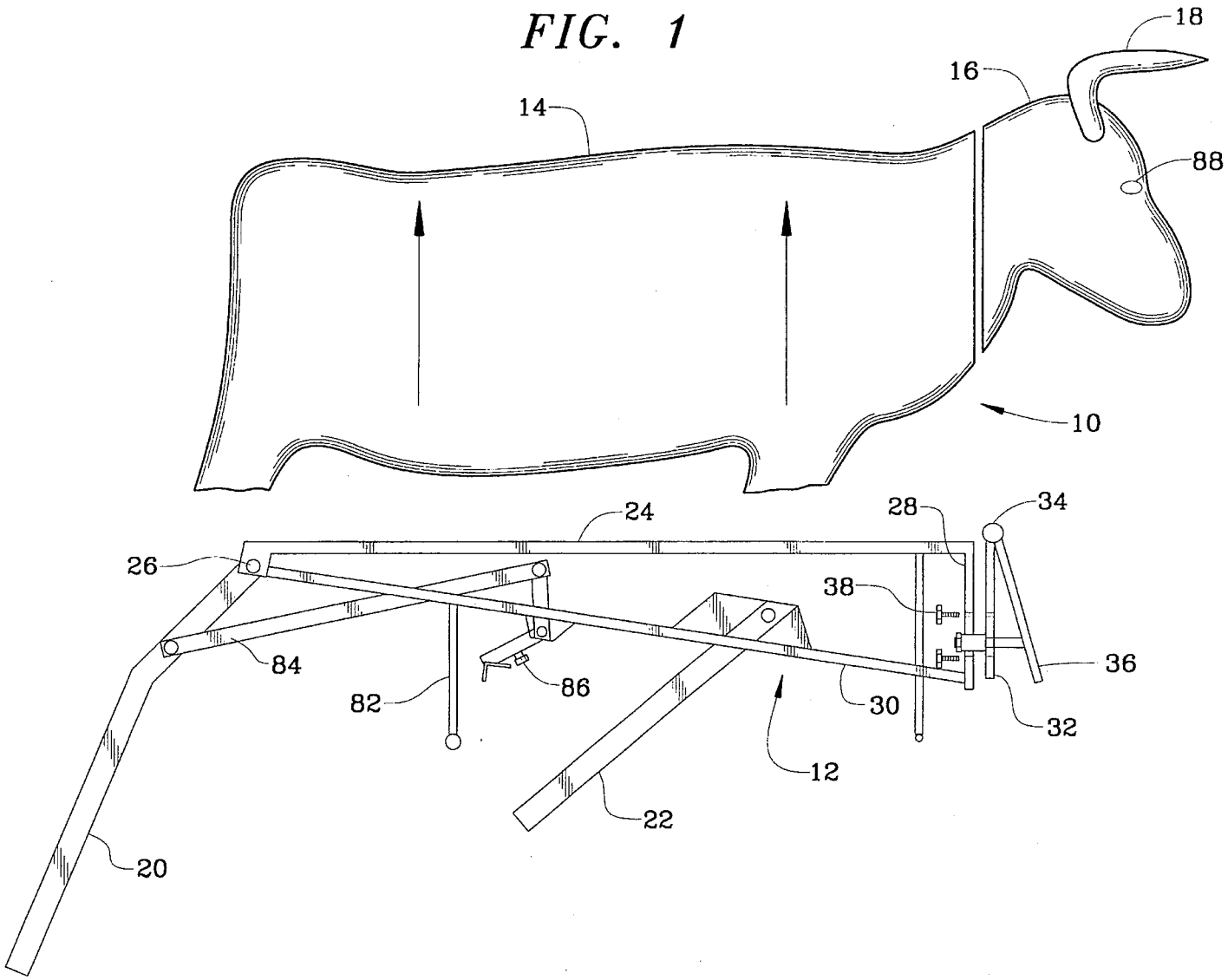
FIG. 1 is an exploded view of the upper frame portion with the body simulation removed.

The present invention comprises a rodeo roping practice steer which has an upper body frame which mounts a body resembling a cow, calf or other bovine animal. Removable 'horns' help with this simulation. The frame provides means for pivotally attaching a head and means for pivotally attaching a front pair of legs and a rear pair of legs. The legs are pivoted in order to create the appearance that the steer can "kick." The head is pivoted in order that it too has a more lifelike appearance. The legs are connected through a linkage system to the drive system for creating the "kicking" of the legs The body frame is mounted upon a second frame, called a cart frame, which supports the drive system for propelling the steer. This includes an electric motor and a suitable source of electricity such as a battery. The motor has two output drive shafts, each of which has an electric clutch/brake, the output of which is drivingly connected two output wheels, mounted at one end of the cart frame. At the other end of the cart frame is a front wheel which is freely pivoted about a vertical axis.

The two electric clutches are controlled independently of each other, in order that the rear drive wheel associated with each of the electric clutches may be independently driven at different speeds. Since the drive wheels are independently driven, by controlling the clutches so that one rear wheel is driven faster or slower than the other, the cart frame is caused to steer to one side or the other. In other words, if the left drive wheel is rotating slower than the right wheel, the steer will turn to the left as the front wheel freely pivots. By driving the two wheels at the same speed, the steer will go straight forward. Similarly, by controlling the speed of the motor, the steer's speed may be varied.

Preferably the drive system includes a control mechanism for the motor and the clutches, and even the battery. Ideally, the drive motor and the electric clutches are controlled by a microprocessor. In this manner, a high degree of random movements may be programmed into the control system for the steer, to simulate a great variety of movement encountered in a rodeo. In the same manner, the microprocessor can program different movements to simulate and/or respond to different events.

In a preferred embodiment, the head of the steer is provided with a suitable sensor for the purpose of detecting when the 'head' of the animal has been successfully roped. Since roping of the head followed by taking up the slack will result in pivoting of the head, preferably the sensor is a switch which can send a signal to indicate when the head is thusly pivoted. This sensor can serve to send a signal to turn off the drive motor. Alternatively, often roping of the head of the animal will result in a change in the actions of the animal. For example, the animal may start kicking more. In such a case, the first sensor sends a signal to start the kicking action of the rear legs. At this point, the roping team may attempt to rope the rear legs of the animal. A second sensor is provided on the pivot mechanism for the rear legs, so that when they are roped and the slack taken out of the rope, the sensor can send a signal to the control and direct the drive wheels to stop driving the cart, indicating a successful completion of the event.

By combining the various operations, the steer can be used to simulate calf roping, team roping, breakaway roping, bull dogging and steer dodging for cutting horses.

In another embodiment, the steer will include a proximity and/or collision avoidance sensor, such as an infrared sensor, at the front of the head. This sensor will serve to turn the motor off and engage the brakes in order to stop the machine and keep it from colliding with an object.

The control system may also include such auxiliary functions as a timer for different actions, a battery condition meter and a clock. Preferably the control system includes a radio transmitter type of remote actuator, similar to those commonly used to control remote devices. This would, for example, allow the steering and speed of the steer to be easily controlled by a remote control such as a joystick. Further, the electrical components mounted on the cart frame may then be housed in a sealed compartment.

The practice roping steer may also include a battery charger which will not only facilitate recharging of the battery.

DETAILED DESCRIPTION OF PREFERRED EMBODIMENTS

The invention will now be described in greater detail with reference to the accompanying drawings. Referring first to FIG. 1, the invention is seen to include a steer body generally designated 10 adapted to be mounted on a body frame generally designated 12. The steer body 10 includes a body portion 14 and a separate head portion 16, both of which may be made, for example, of a molded plastic material and painted to closely resemble a bovine animal. The head portion 16 also includes horns 18 which are removable.

The body frame 12 includes rear legs 20 and front legs 22. Preferably at least the rear legs 20 are pivotally attached to the frame portion 24 at a pivot connection 26. The frame 12 also includes, for example, a front member 28 and a diagonal member 30. Secured to the front member 28 is a mounting member 32 having a pivot connection 34 and a pivot plate 36. The member 32 may be secured to the frame 28 by bolts 38, for example. The pivot plate 36 serves to mount the head 16 to the frame. In this manner, the head may pivot with respect to the body, which is attached to the frame 24. A sensor member 40 is mounted to the members 28 and 32, and serves to detect pivoting of the plate 36, i.e. the head 16, with respect to the body, and send an electrical signal when that pivoting occurs.

Figure 2:
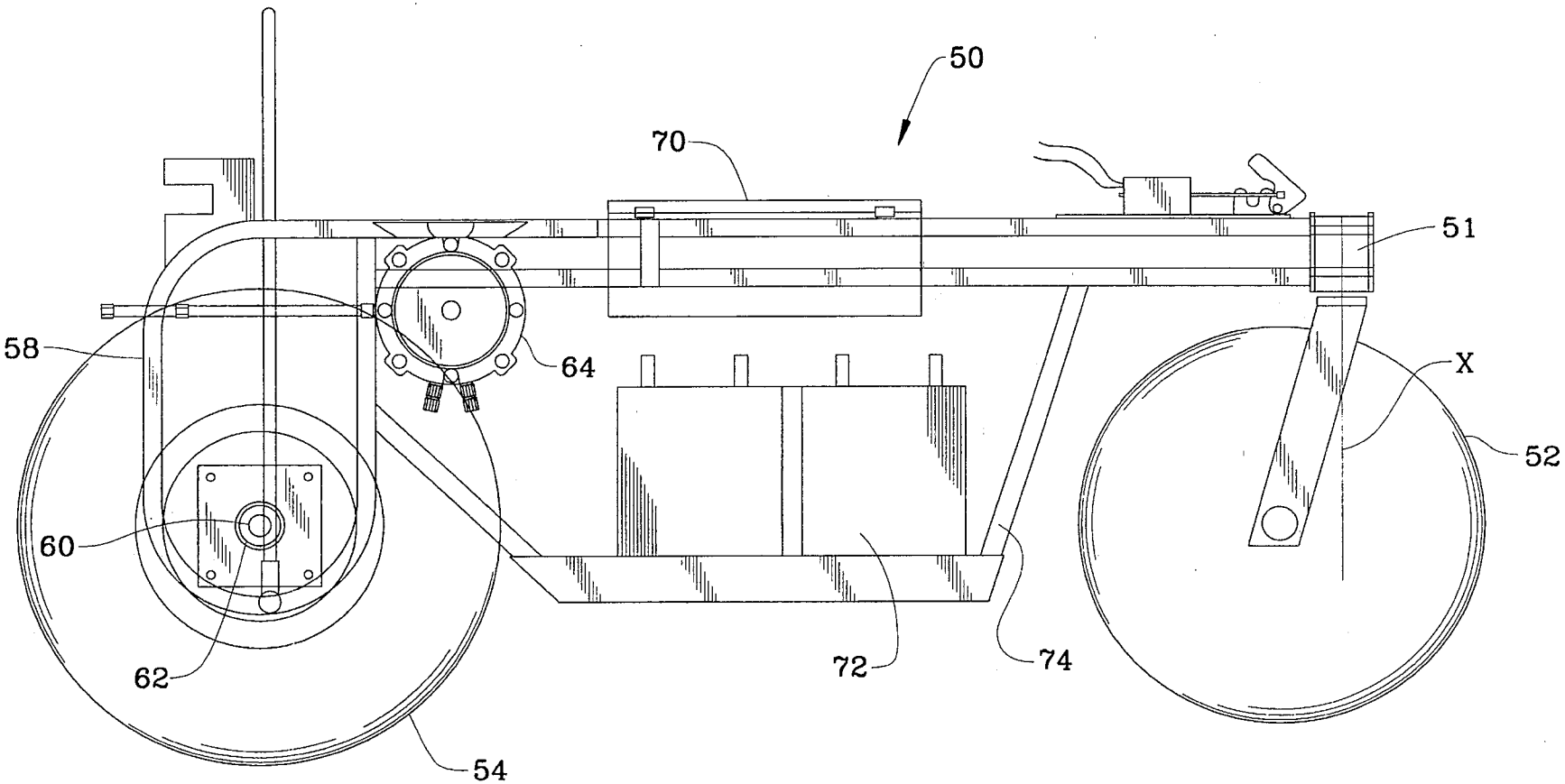
FIG. 2 is a schematic side view of the lower frame and power train.
Figure 3:
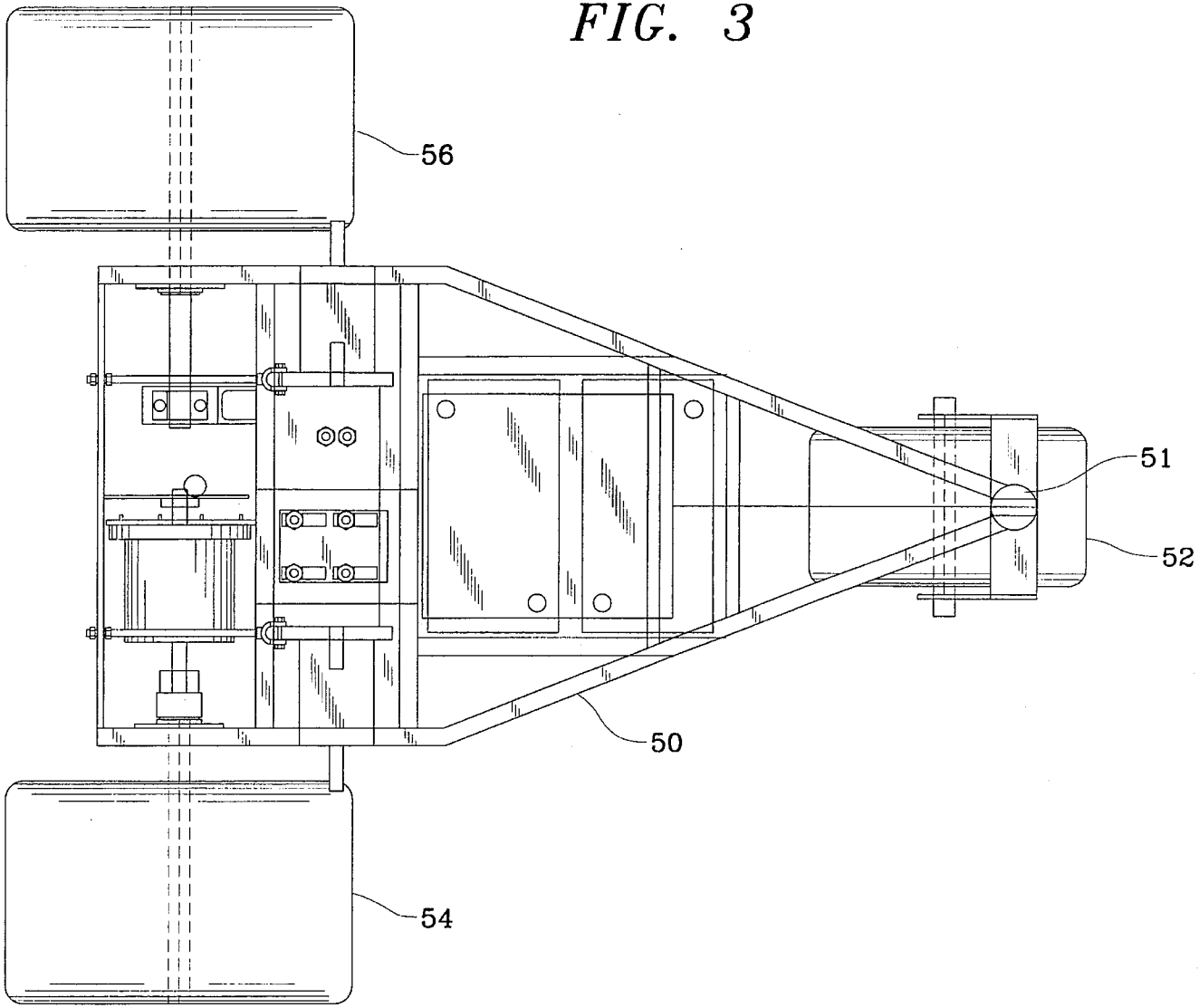
FIG. 3 is a top view of the lower frame and power train structure of FIG. 2.
Figure 4:
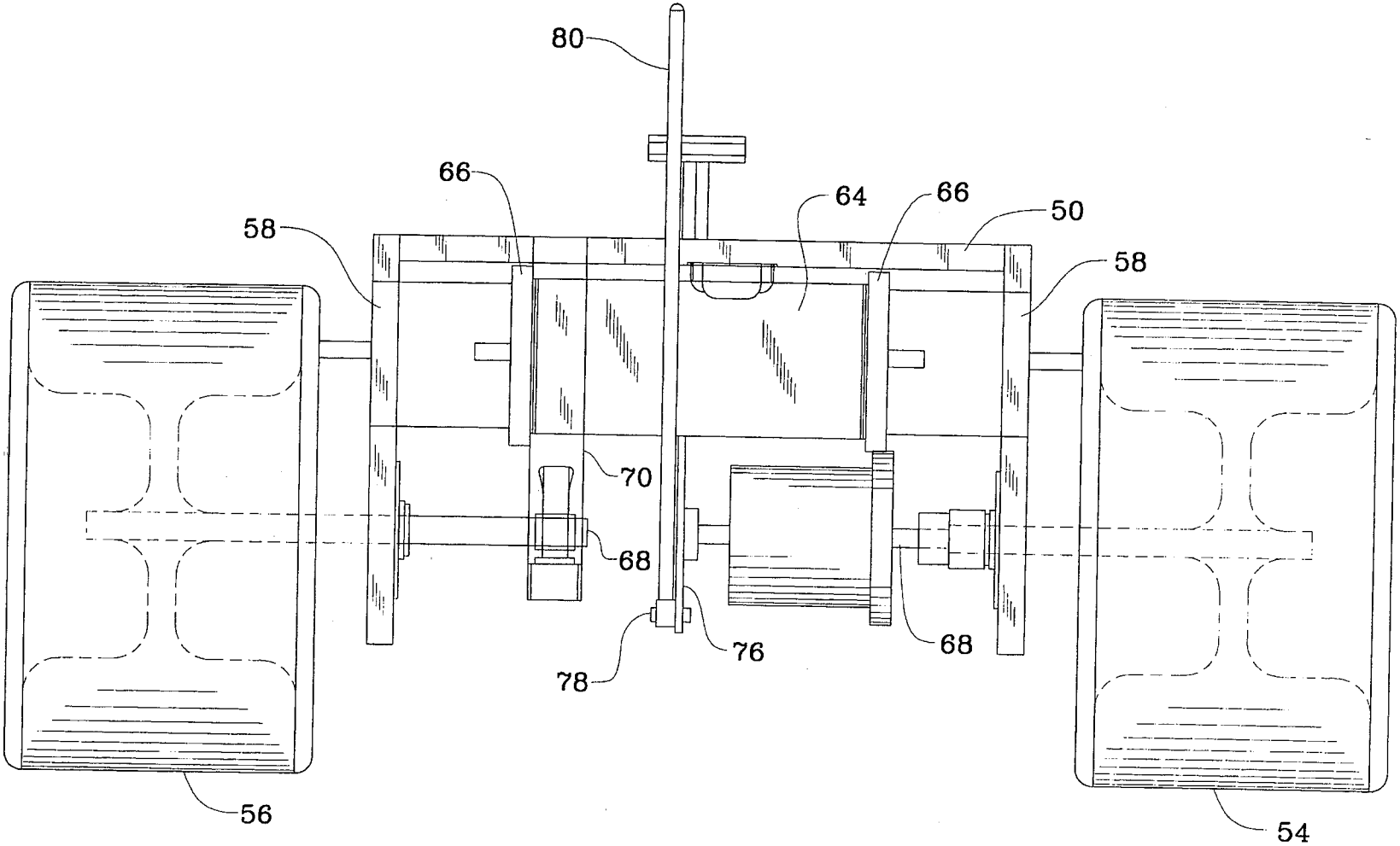
FIG. 4 is a rear view of the lower frame and power train structure of FIG. 2.

Referring now to FIGS. 2–4, a cart frame 50 includes a front wheel 52 mounted as a castor wheel on a bushing 51 secured to the frame 50 so as to freely pivot about a vertical axis X. A pair of rear wheels 54, 56 are mounted on an axle 60 housed in a bearing 62 mounted on depending portions 58 of the frame 50. An electric drive motor 64 is mounted on the frame 50, and is of the type having a drive output at each end of the armature shaft. Thus, on each end of the motor is an electric brake or clutch 66, and each is connected to one of the drive shafts 68, for example by a belt and pulley or by a chain and sprocket connection.

Each of the electric clutches (brakes) is separately operated by a control system. The control system is housed in a sealed control box above the battery or batteries 72. The batteries are mounted on a depending portion 74 of the frame 50, in order to keep the weight, and thus the center of gravity, of the steer low, and to make the steer more maneuverable with less likelihood of tipping over. The motor also includes another output through another electric clutch (not shown) connected to a pulley 76 having an eccentric connection with a pin member 78 at the end of a rod 80. The rod 80 is connected to a drive rod 82 on the frame 24, and through a link 84 to the rear legs 20. When the pulley 76 is caused to rotate, the rear legs 20 are caused to "kick." A sensor 86 is mounted so as to detect a resistance or stoppage of the kicking action, as when the rear legs are roped.

The front legs 22 may also be pivotally attached to the frame, and may also be connected to the rod 80 in order to pivot with the rear legs. But, since the front legs are not usually used in roping, this drive connection may be eliminated.

The head 16 may be provided with "eyes," one, 88, of which is a proximity detection sensor. This sensor will detect the presence of an object directly in front of the steer and turn off the drive motor 64. This serves as a safety mechanism to avoid injury to a person in front of the steer or damage to the steer.

The control system would preferably comprise a microprocessor receiving input signals from the sensors and sending signals to the drive clutches to vary the speed of the outputs to the drive wheels. Because of the front caster wheel, controlling the speed of the drive wheels independently enables steering of the steer. As is known in the microprocessor field, such signals may be randomized or set to a preprogrammed sequence, as desired. A number of different sequences may be programmed into the control to simulate different events, and these can even be used selectable. By including a multifunction remote transmitter, a distant user can control the operation of the steer.

While this invention has been described as having certain preferred features and embodiments, it will be understood that it is capable of still further variation and modification without departing from the spirit of the invention, and this application is intended to cover any and all variations, modifications and adaptations of the invention as may fall within the spirit of the invention and the scope of the appended claims.

I claim:

1. A rodeo roping practice steer comprising a body frame for mounting a body resembling a bovine animal, first pivot connecting means for pivotally attaching a head to said body frame and second pivot connecting means for pivotally attaching at least one pair of legs to said body frame, a cart frame for mounting said body frame, said cart frame including a pair of rear drive wheels and a front wheel member pivotal about a vertical axis, an electric motor having two output drive shafts, electric clutch and brake means mounted on each of said drive shafts and drivingly connected with said drive wheels, means interconnecting at least one of said drive shafts and said second pivot connecting means for pivotally moving said pair of legs, a source of electricity for driving said motor, control means for selectively engaging and disengaging said electric clutch and brake means and said second pivot connecting means, a first sensor member mounted on said body frame for delivering a first signal to said control means in response to a condition sensed by said first sensor member, and directing a change in the operation of said electric motor in response to said first signal.

2. A rodeo roping practice steer as in claim 1 and wherein each of said electric clutch and brake means is connected to one of said drive wheels, and said electric clutch and brake means are independently operable for independently controlling the rotation of each of said drive wheels for steering said cart frame.

3. A rodeo roping practice steer as in claim 2 and wherein said control means comprises a microprocessor for commanding the engagement and disengagement of said electric clutch and brake means.

4. A rodeo roping practice steer as in claim 3 and wherein said first sensor member detects pivoting of said head as an indication that said head has been roped.

5. A rodeo roping practice steer as in claim 4 and wherein said control means directs initiation of kicking motion of said legs in response to said first signal.

6. A rodeo roping practice steer as in claim 3 and wherein said first sensor member detects the presence of an object in front of said steer and turns off said electric motor in response to said first signal.

7. A rodeo roping practice steer as in claim 3 and including a second sensor mounted on said body frame for delivering a second signal to said control means in response to a condition sensed by second sensor member, and directing a second change in the operation of said electric motor in response to said second signal.

8. A rodeo roping practice steer as in claim 7 and wherein said second sensor member detects the presence of an object in front of said steer and turns off said electric motor in response to said second signal.

9. A rodeo roping practice steer as in claim 5 and including a second sensor mounted on said body frame for delivering a second signal to said control means in response to roping of said legs, and directing turning off of said electric motor in response to said second signal.

10. A rodeo roping practice steer as in claim 5 and wherein said electric motor is a variable speed motor.

11. A rodeo roping practice steer as in claim 5 and wherein said control means is mounted in a sealed housing on said cart frame.

* * * * *